US007147117B2

(12) United States Patent
Davis et al.

(10) Patent No.: US 7,147,117 B2
(45) Date of Patent: Dec. 12, 2006

(54) TOWER CRANE DEVICE

(75) Inventors: Larry Davis, Mississauga (CA); Larry Howard, Milton (CA); Michael Schiavoni, Piscataway, NJ (US)

(73) Assignee: Federated Equipment Co. LLC, Piscataway, NJ (US)

( * ) Notice: Subject to any disclaimer, the term of this patent is extended or adjusted under 35 U.S.C. 154(b) by 775 days.

(21) Appl. No.: 10/309,586

(22) Filed: Dec. 4, 2002

(65) Prior Publication Data

US 2003/0121875 A1 Jul. 3, 2003

Related U.S. Application Data

(62) Division of application No. 09/813,413, filed on Mar. 21, 2001.

(51) Int. Cl.
*B66C 23/30* (2006.01)

(52) U.S. Cl. ..... 212/179; 212/203; 212/204

(58) Field of Classification Search ..... 212/175, 212/176, 179, 296, 199, 202, 205, 204
See application file for complete search history.

(56) References Cited

U.S. PATENT DOCUMENTS

| | | | | |
|---|---|---|---|---|
| 1,788,451 | A * | 1/1931 | Clapp | 198/360 |
| 2,858,945 | A | 11/1958 | Pingon | |
| 3,153,486 | A * | 10/1964 | Strnad | |
| 3,207,475 | A * | 9/1965 | Johansson et al | |
| 3,217,896 | A * | 11/1965 | Cannella | |
| 3,245,551 | A | 4/1966 | Van Hezik | |
| 3,464,169 | A * | 9/1969 | Potain | |
| 3,485,384 | A | 12/1969 | Sei Nikai et al. | |
| 3,656,631 | A | 4/1972 | Rauch et al. | |
| 3,789,565 | A | 2/1974 | Lindholm | |
| 3,818,084 | A * | 6/1974 | Tamburini | 264/33 |
| 3,894,635 | A | 7/1975 | Reich | |
| 3,982,634 | A | 9/1976 | Miyazaki | |
| 3,998,029 | A | 12/1976 | James et al. | |
| 4,028,792 | A | 6/1977 | Tax et al. | |
| 4,125,193 | A | 11/1978 | Matsumoto | |
| 4,205,826 | A | 6/1980 | Ten Broeke et al. | |
| 4,757,592 | A * | 7/1988 | Reed | 29/429 |
| 5,417,018 | A * | 5/1995 | Matsumoto et al. | 52/123.1 |
| 5,645,395 | A | 7/1997 | Huang | |
| 5,881,504 | A | 3/1999 | Wakisaka et al. | |

FOREIGN PATENT DOCUMENTS

| | | |
|---|---|---|
| DE | 2042337 | 3/1972 |
| DE | 2042338 | 3/1972 |
| DE | 7817700 | 9/1978 |
| GB | 964058 | 7/1964 |
| JP | 64002994 | 1/1989 |
| JP | 1-271396 | * 10/1989 |
| JP | 5-155580 | * 6/1993 |
| JP | 06127889 | 5/1994 |
| JP | 2000203788 | 7/2000 |
| JP | 2001010780 | 1/2001 |

* cited by examiner

*Primary Examiner*—Thomas J. Brahan
(74) *Attorney, Agent, or Firm*—Baker & McKenzie LLP

(57) ABSTRACT

A crane tower device includes a basket that supports a tower crane and sits within a bay formed by the vertical columns of a building under construction. The basket and the tower crane are supported by support stubs that are attached to the vertical columns. Because the lateral and vertical load is principally distributed vertically to the vertical columns rather than horizontally, no reinforcement of the horizontal beams, floors or any other portion of the building structure are needed, which results in substantial cost savings.

33 Claims, 11 Drawing Sheets

TOWER CRANE DEVICE

CROSS-REFERENCE TO RELATED APPLICATIONS

This is a division of application Ser. No. 09/813,413, filed Mar. 21, 2001.

FIELD OF THE INVENTION

The present invention relates to tower cranes, and more particularly, tower crane lifting devices.

BACKGROUND OF THE INVENTION

As is well-known, tower cranes are used in constructing buildings. Some are free-standing, but the types of tower cranes to which this invention relates are generally positioned within the building under construction, supported by the building structure, usually passing through aligned floor slab openings created for this purpose. The tower of the tower crane is usually supported from one floor, extending upward through aligned openings in all completed upper floors. As construction of the building progresses and the floors approach the boom of the crane, the tower, crane and boom must be raised or "jumped" to a higher elevation.

For jumping the tower, one system previously in common use employed a hydraulic cylinder connected to a specially equipped lower mast section, with an additional cross piece connected to the cylinder and engaged in a pair of opposed ladder-like columns extending from the lower floors to the top of the building alongside the tower, within the shaft of floor openings. Dogs of this lifting structure would engage on rungs or slots of these ladder devices, moving up the ladders and engaging new slots as the lifting cylinder was actuated. Since the ladder devices extended through the entire height of the building, they served as supporting means for the working crane, as well as being involved in the lifting operation when raising of the crane was required.

In another lifting system which has been widely used, jacks were positioned on a floor of the building structure, with smooth lifting rods depending downwardly from the jacks to a connecting device engagable with a specially equipped mast section. A device associated with the jacks and having teeth would grasp each rod for the lifting stroke. The specially equipped mast section, normally located at the bottom of the tower crane, had holes for receiving the connecting device, which extended laterally through the mast. The tower crane was supported entirely by the rods and connecting device while being lifted by a series of jacking strokes.

For supporting the crane after it was lifted to the new elevation, this latter system utilized I-beams inserted horizontally through a mast section. The jacks lowered the crane a short distance, to rest the I-beam on a building floor.

For these prior lifting systems, it is important to provide not only suppport for the vertical load of the tower crane, but also for the lateral load or side loading to prevent the crane from tipping and to accept twisting forces induced by the boom.

Initially when no floors have been erected, a relatively deep foundation and long support rods that tie the tower to the foundation are provided to prevent the side loading or turning moment of the boom from toppling the crane. As floors are added, the vertical and lateral loads are distributed to either the floors or the horizontal beams or both. These loads are greater than the floors and horizontal beams would normally experience after construction, and the floors and horizontal beams are therefore specially reinforced and shored to accept these additional loads that the tower crane imparts. Moreover, the bay of a building under construction is usually larger than the cross sectional area of a tower supporting the crane. Consequently, the floor space of the bay, as each floor is added, is filled around the tower with little clearance solely to accommodate the crane. The filled floor space is also generally reinforced. To provide further lateral support, chucking such as braces, wedges or plates are also provided over the floors around the opening for the tower.

As persons of ordinary skill in the art can appreciate, however, these added features involve a substantial amount of additional construction materials and labor solely to accommodate the tower crane. As a result, construction cost increases substantially and the added space of the extra construction materials reduces the usable space of the building. Moreover, conventional crane lifting systems are cumbersome to operate, often requiring an entire day or more to jump the crane, resulting in substantial construction down time.

Therefore, there is a need to provide an improved tower crane lifting device in which the crane load is not distributed to the horizontal beams and the lifting can be performed relatively rapidly with minimum down time.

SUMMARY OF THE INVENTION

According to the principles of the present invention, there is provided a crane tower device that overcomes the many disadvantages of the prior systems. The device includes a basket that supports a tower crane and sits within a bay formed by the vertical columns of a building under construction. The basket and the tower crane rest upon support stubs that are attached to the vertical columns.

Because the lateral and vertical load is principally distributed vertically to the vertical columns rather than horizontally, no reinforcement of the horizontal beams, floors or any other portion of the building structure are needed, which results in substantial cost savings.

According to another principles of the present invention, a lifting device uses a lifting frame and a lifter to efficiently jump the crane to minimize construction down time.

DETAILED DESCRIPTION OF THE INVENTION

Figure 1:
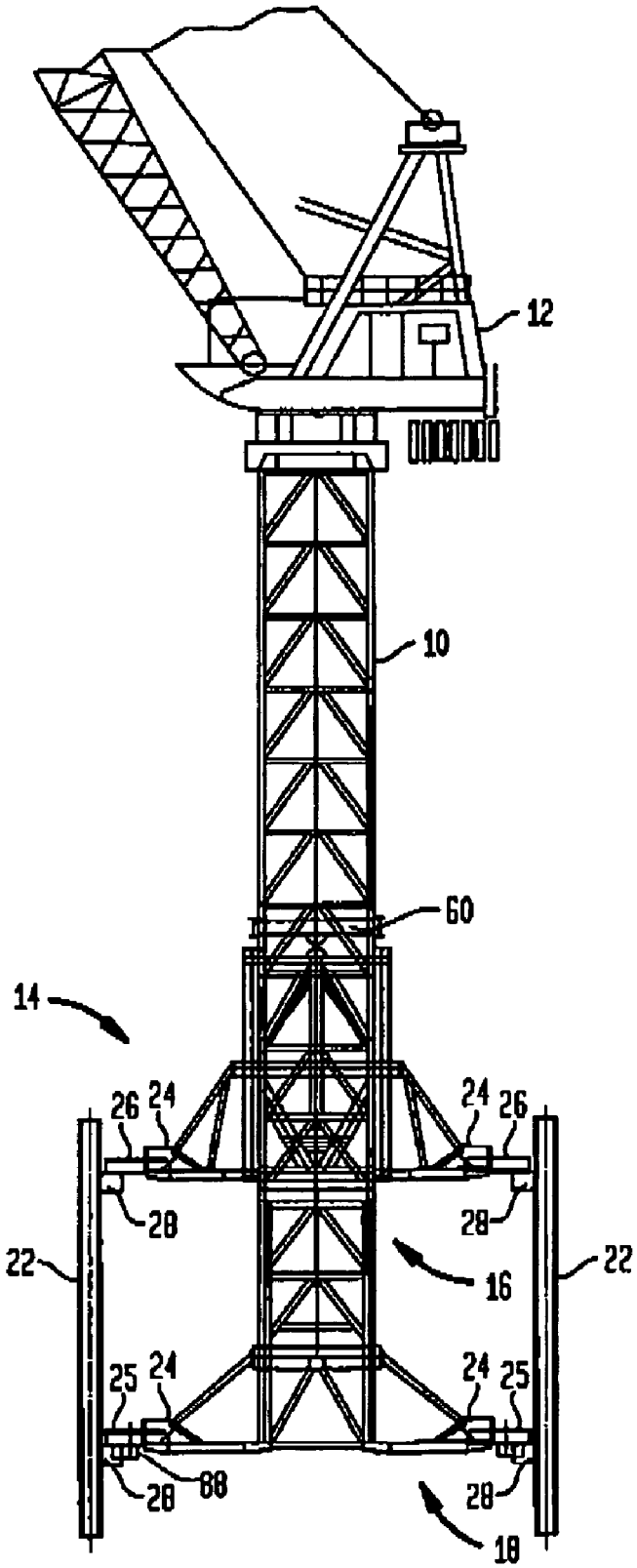
FIG. 1 is a elevation view of a tower crane being supported by a lifting device according to the present invention.

Generally, the type of tower crane lifting devices to which this invention relates is positioned within a bay of a building under construction. Illustrated in FIG. 1 is a tower 10 supporting a crane 12. The combination of the tower 10 and the crane 12 are often called a tower crane. The tower 10 is being supported by a lifting device 14 according to the present invention which is positioned within four vertical columns 22 (only two are shown) of a bay. The lifting device 14 includes an upper base or basket 16, a lower base or basket 18, and a rectangular lifting or climbing frame 60 for jumping the tower 10. The upper basket 16 and the lifting frame 60 surround and are vertically slidable with respect to the tower 10. The tower 10 rests on and is attached to the lower basket 18. Each basket 16, 18 has four outriggers 24 having slidable foot members 25. The outriggers 24 are operated by a hydraulic pump (not shown). The upper and lower baskets 16, 18 rest upon support stubs 28 that are attached to the vertical columns 22 of a building structure (not shown).

Figure 2:
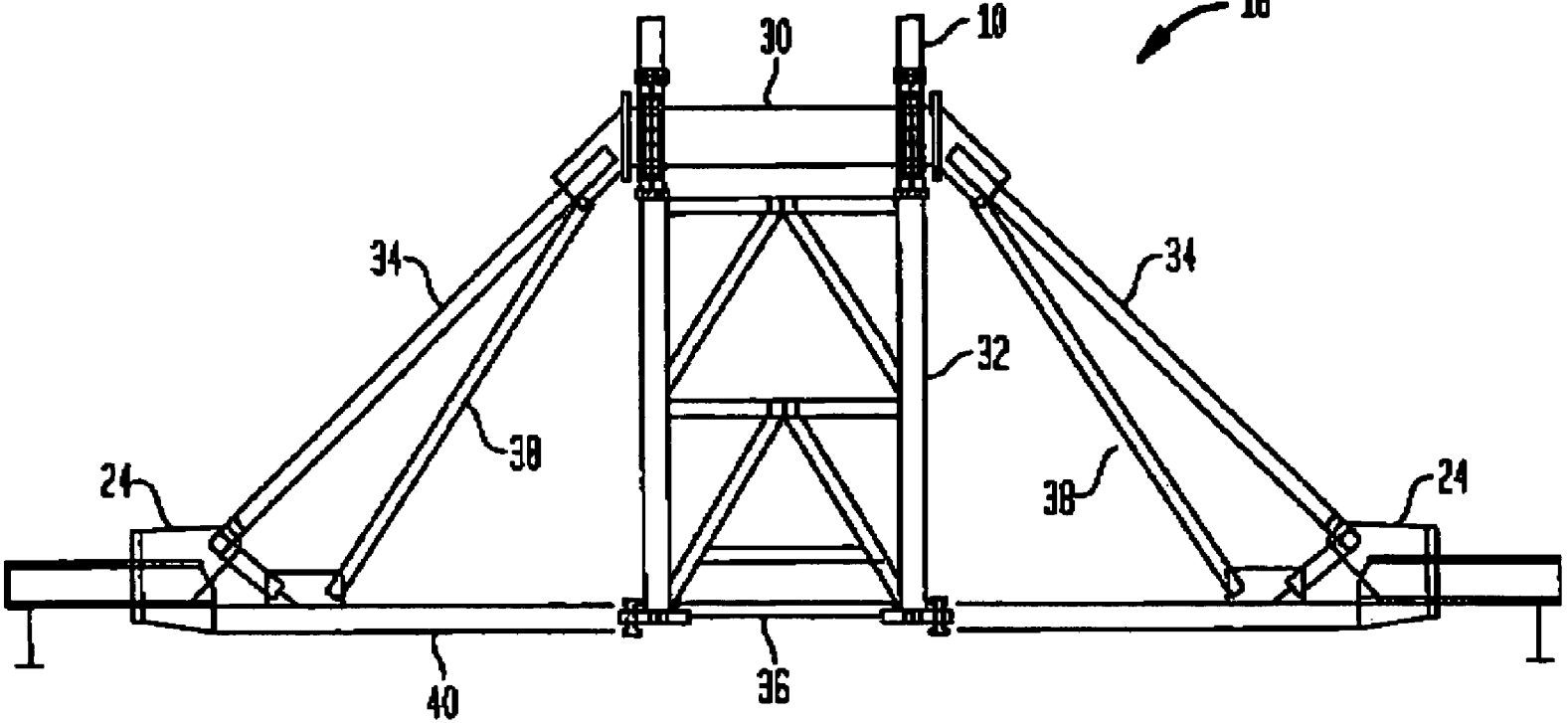
FIG. 2 is a side view of a lower basket of the lifting device according to the present invention.
Figure 11:
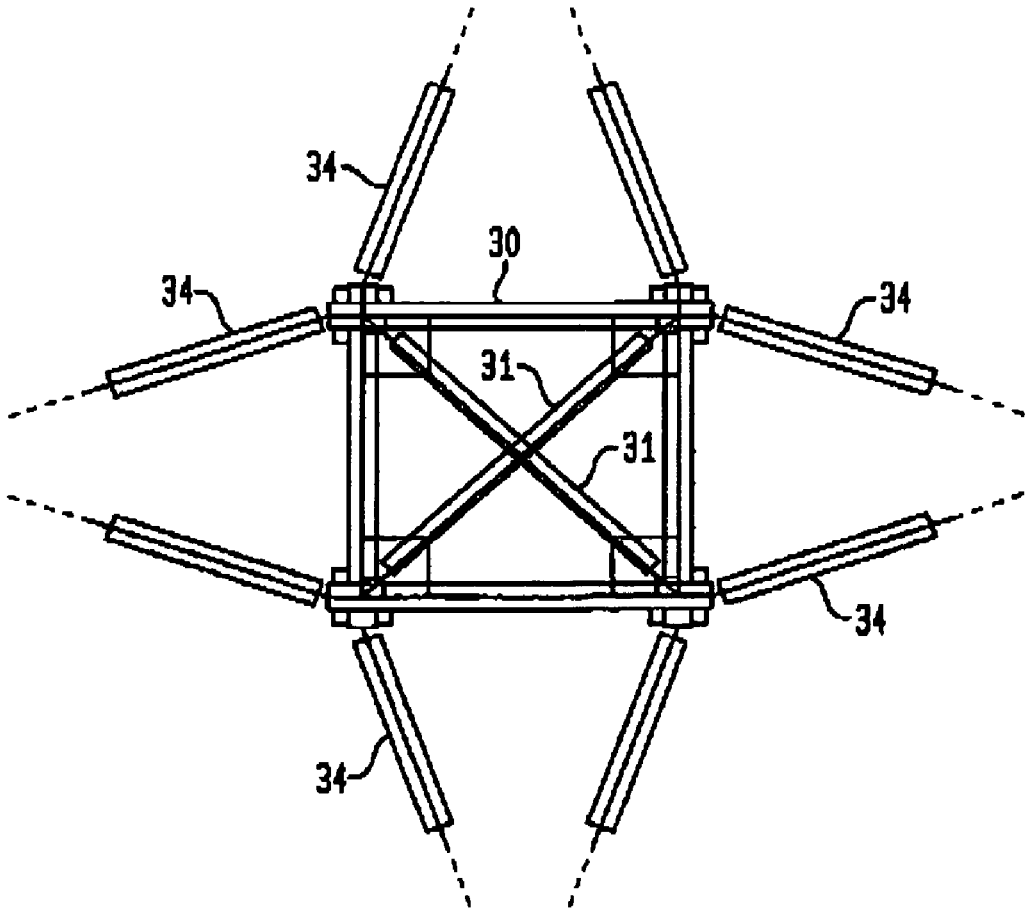
FIG. 11 is a plan view of a portion of the lower and upper baskets according to the present invention.

FIG. 2 is a more detailed side view of the lower basket 18. The lower basket 18 includes a rectangular upper frame 30 and a rectangular lower frame 36, which are attached to the opposite ends of a base tower section 32. The tower 10 supporting the crane 12 is bolted to the upper frame 30 of the lower basket 18. An outer sloped arm 34 including a pair of symmetric frames (one frame being hidden behind the other) for each side extends from the upper frame 30 and are attached pivotally to the respective outrigger 24. Similarly, an inner sloped arm 38 including a pair of symmetric frames (one frame being hidden behind the other) for each side extends from the upper frame 30 and are attached to the respective outrigger 24. The sloped arms 34 and 38 extend toward the respective support stubs 28 to transfer the lateral loads to the vertical columns. FIG. 11, which is a plan view of a portion of the lower basket 18, shows the two symmetric frames of the outer sloped arms 34. The diagonal braces 31 welded at their midpoints are attached to the corners of the upper frame 30 to strengthen the frame.

Figure 3:
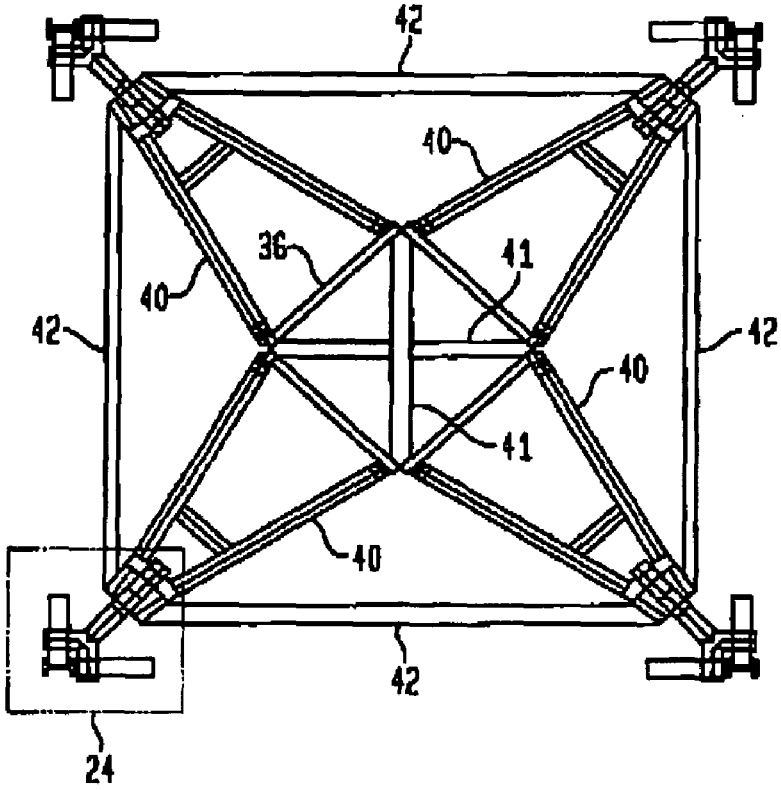
FIG. 3 is a plan view of a portion of the lower basket according to the present invention.

As shown in FIGS. 2 and 3, one end of each horizontal arm 40 is connected to the respective outrigger 24 and the other end is pivotally (both horizontally and vertically) attached to the lower frame 36. The diagonal braces 41 welded at their midpoints are attached to the corners of the lower frame 36 for strength. The various pivots are used to absorb the lateral load of the lifting device 14 when in operation. As shown in FIG. 3, the outriggers 24 are also attached to a rectangular outer frame 42 whose diameter is larger than that of the upper frame 30. To allow workers to walk on the basket 18 when performing a climbing (jumping) operation, a platform (not shown) between the inner frame 36 and the outer frame 42 can be provided over the horizontal arms 40.

Figure 4:
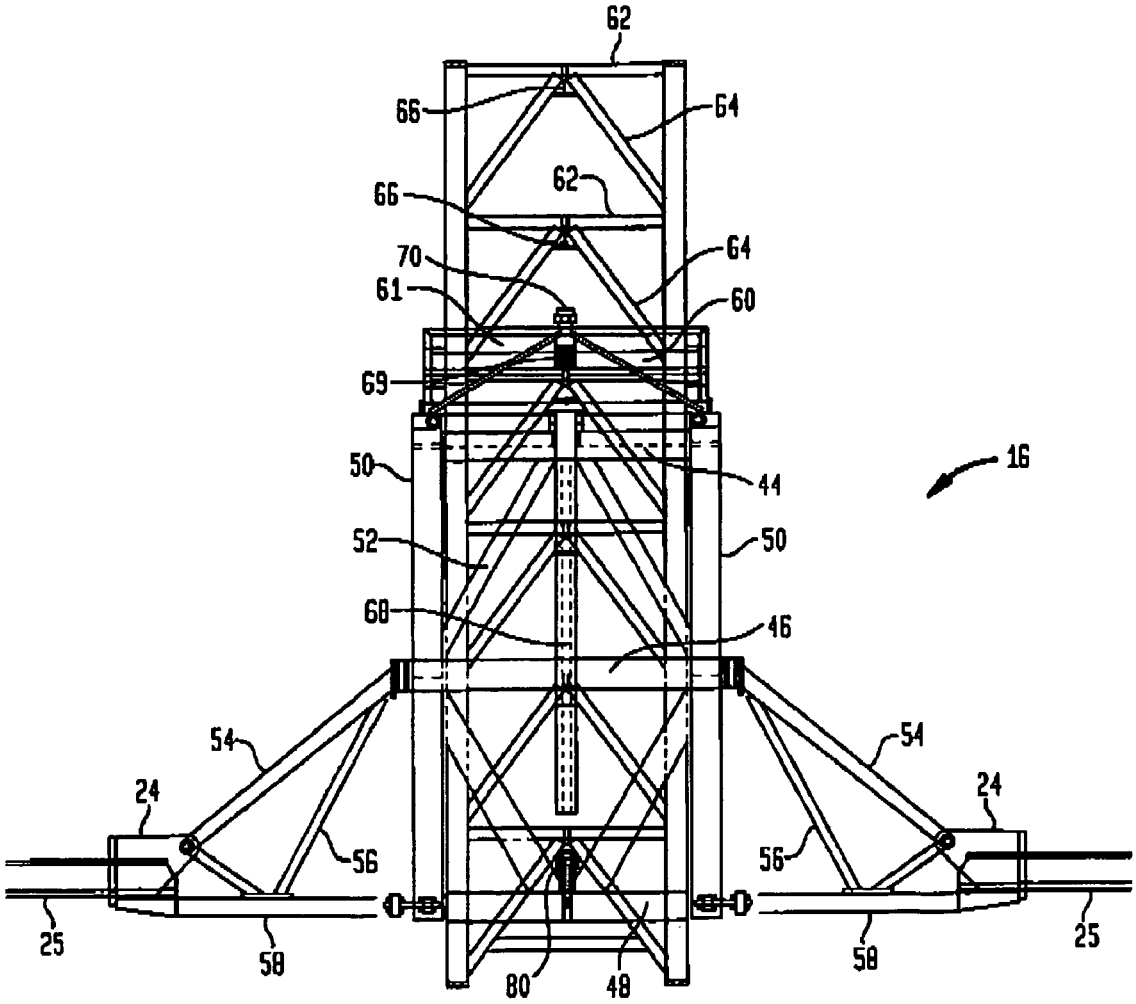
FIG. 4 is a side view of an upper basket of the lifting device according to the present invention.

FIG. 4 is a side view of the upper basket 16. The basket 16 includes a rectangular upper frame 44, a rectangular center frame 46, a rectangular lower frame 48 and vertical beams 50 which surround the tower 10 and are attached to each other by the rectangular upper frame 44, the rectangular center frame 46 and the rectangular lower frame 48. Braces 52 attached to the vertical beams 50 and the lower frame 48 provide rigidity to the upper basket 16.

Similar to the lower basket 18, an outer sloped arm 54 including a pair of symmetric frames (one frame being hidden behind the other) for each side extends from the center frame 46 and are attached pivotally to the respective outrigger 24. Similarly, an inner sloped arm 56 including a pair of symmetric frames (one frame being hidden behind the other) for each side extends from the center frame 46 and are attached to the respective outrigger 24. In the embodiment shown, the two symmetric frames of the outer sloped arms 34 and the diagonal braces 31 for the upper frame 30 in FIG. 11 are identical in structure to those of the upper basket 16.

One end of each horizontal arm 58 is connected to the respective outrigger 24 and the other end is pivotally (both horizontally and vertically) attached to the lower frame 48. The outriggers 24 are attached to an outer frame (not shown) similar to 42 as shown in FIG. 3. To allow workers to walk on the basket 16 when performing a jumping operation, a platform and guide rails (not shown) can also be provided.

Advantageously, the vertical load including the lifting device 14, tower 10 and crane 12 is principally distributed on the vertical columns 22. Moreover, the turning moment or the lateral load of the crane is transferred through the sloped arms 34, 38, 54, 56 to the vertical columns. Thus, there is no need to reinforce the horizontal beams or the floors or any other portion of the building to accommodate the crane.

Figure 12:
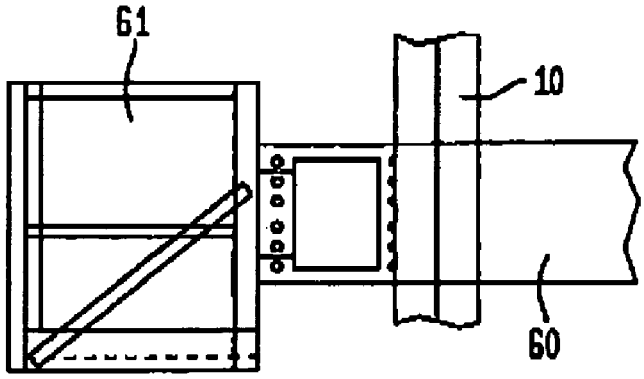
FIG. 12 is a side view of a portion of a lifting frame according to the present invention.

A rectangular climbing frame 60 surrounds the tower 10 and is disposed above the upper basket 16. A pair of platform frames 61 (one frame being hidden by the other) are attached to the opposite sides of the climbing frame 60 as more clearly shown in FIG. 12. The platform frames 61 are thicker and wider than the climbing frame 60.

The tower 10 includes horizontal slots or bracing 62 that are welded to diagonal bracing 64 at their mid points. To strengthen the midpoints of the horizontal bracing 62, which are used for climbing operation, angles 66 are welded to the diagonal bracing 66.

A pair of hydraulically operated jacks including cylinders (only one shown) 68 are attached to the opposite sides of the upper and center frames 44 and 46 while the corresponding pistons 69 are attached to the platform frames 61. The jacks operate as a lifter of the tower 10 as described below.

Figure 5A:
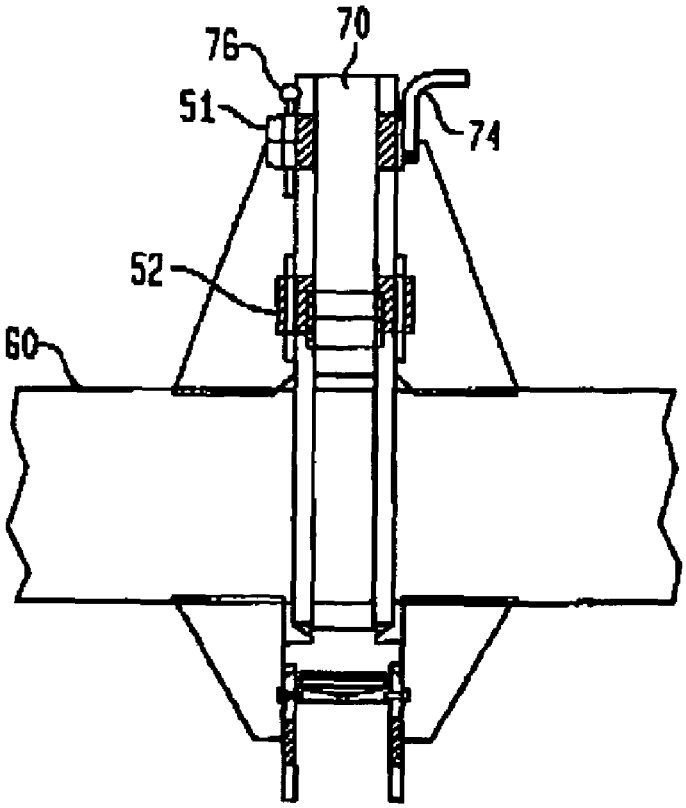
FIG. 5A illustrates a dog according to the present invention.
Figure 5B:
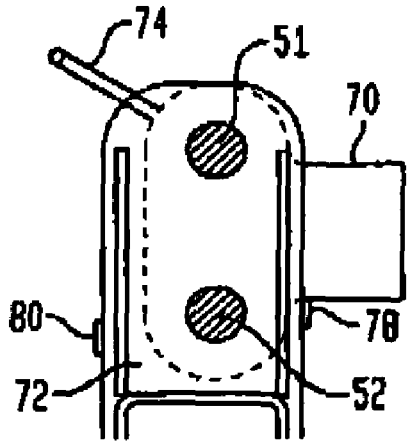
FIG. 5B is a side view of the dog of FIG. 5A according to the present invention.

A locking device such as a pair of dogs 70 (only one shown) are opposedly attached to the climbing frame 60 as shown in FIGS. 5A and 5B. The dog 70 is rotatable with respect to its housing 72. The dog 70 is shown in a locked position resting on a stop plate 78 with a locking pin 76 inserted through pin 51, as shown in FIG. 5A, to lock the dog 70 to its housing 72. To move the dog 70 to an unlocked position, the pin 76 and the pin 51 are removed and the dog 70 is tilted back using a handle 74 until the dog rests on a stop plate 80. A second pair of dogs 80 (only one shown) are attached to the opposite sides of the lower frame 48. The two pairs of dogs 70, 80 are used to assist in the climbing operation as will be explained later herein.

Figure 6:
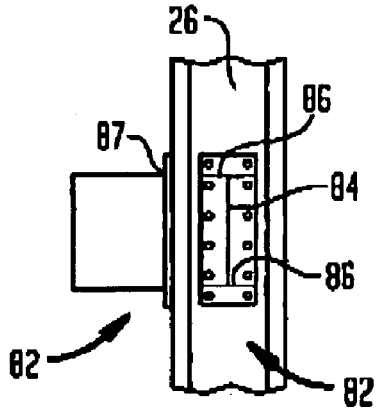
FIG. 6 illustrates a support stub according to the present invention.
Figure 7A:
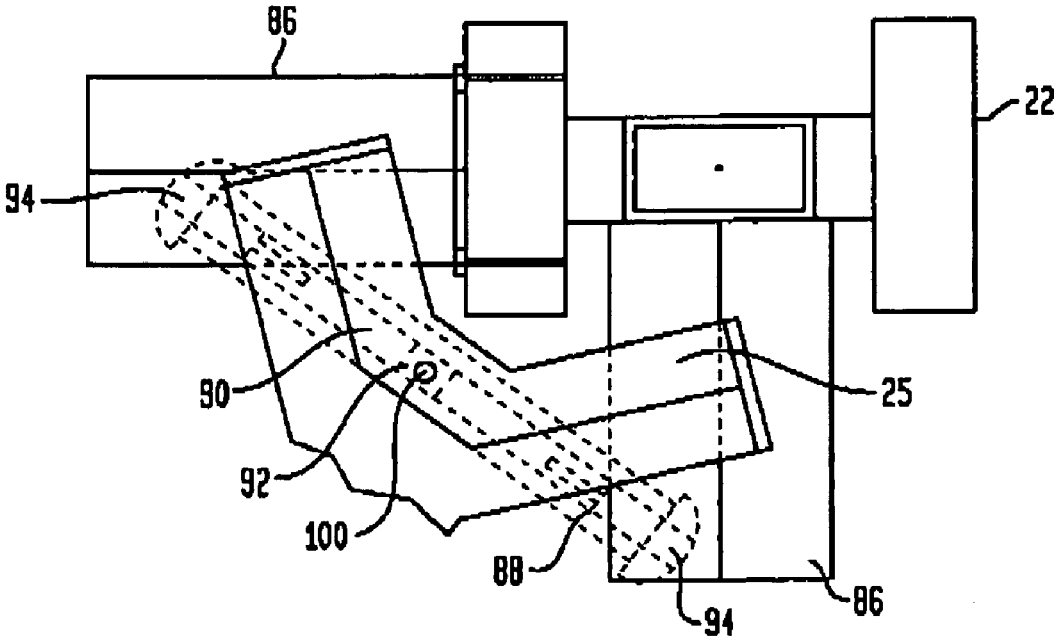
FIG. 7A is a pla view of the support stubs and the outrigger foot members resting on the support stubs according to the present invention.

When the tower 10 is not being raised, the foot members 25 of the outriggers 24 are extended and are resting on the support stubs 28. Referring to FIGS. 6 and 7, the stub 28 is either shop welded or bolted to the respective vertical column 22. The stub 28 as shown has two stub members 82 disposed at right angle to each other. The two stub members 82 are respectively attached to the web and flange of the vertical column 22. Each stub member 82 includes a back plate 87 attached to the column 26, a web 84, and top and bottom flanges 86.

To further secure the tower crane 12 to the lower basket 18, the foot members 25 are clamped using a clamp such as a yoke 88 as shown in FIGS. 1, 8, 9 and 10. The yoke 88 includes a main plate 90 having a through hole 92 and recesses 94 on both ends for receiving left and right plates 96. Each plate 96 has an angled rod or rib 98 welded to the top of the plate at a 45 degree angle.

Figure 7B:
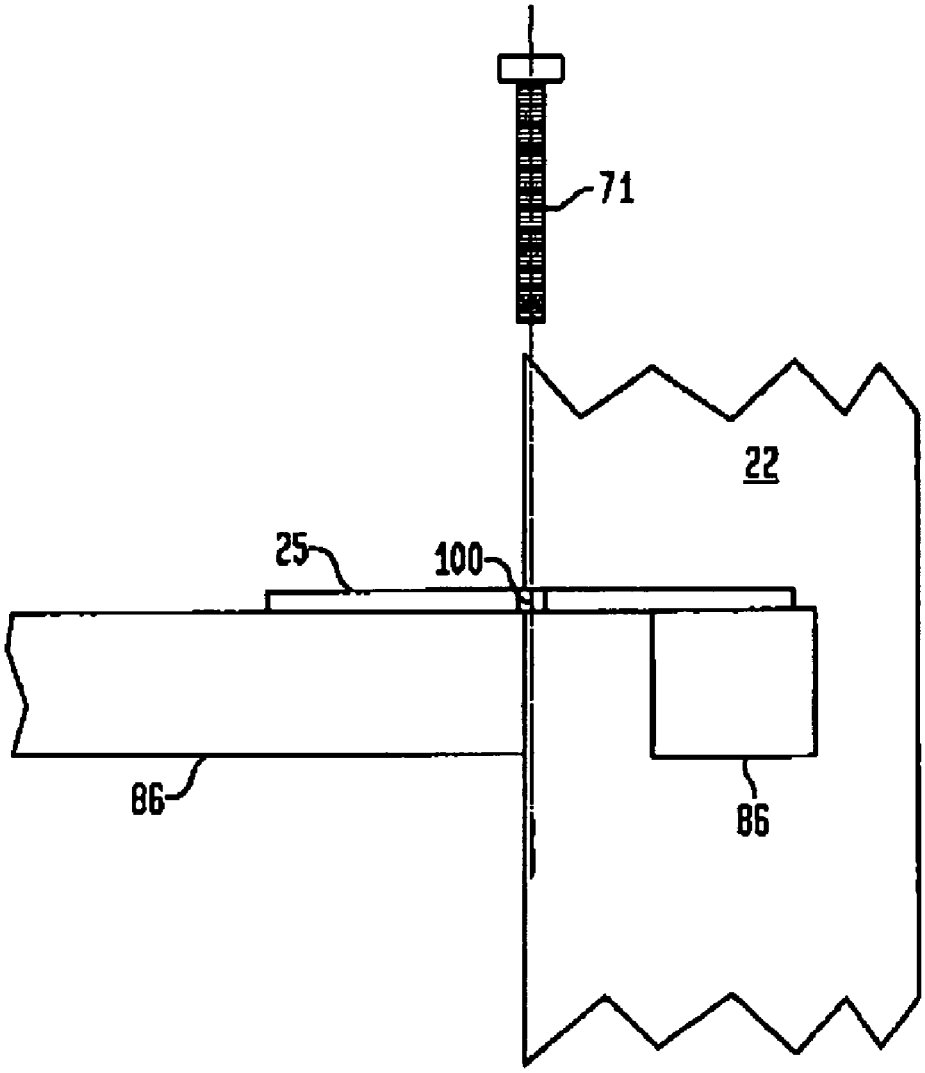
FIG. 7B is a side view of the support stubs and the outrigger foot members resting on the support stubs according to the present invention.
Figure 8:
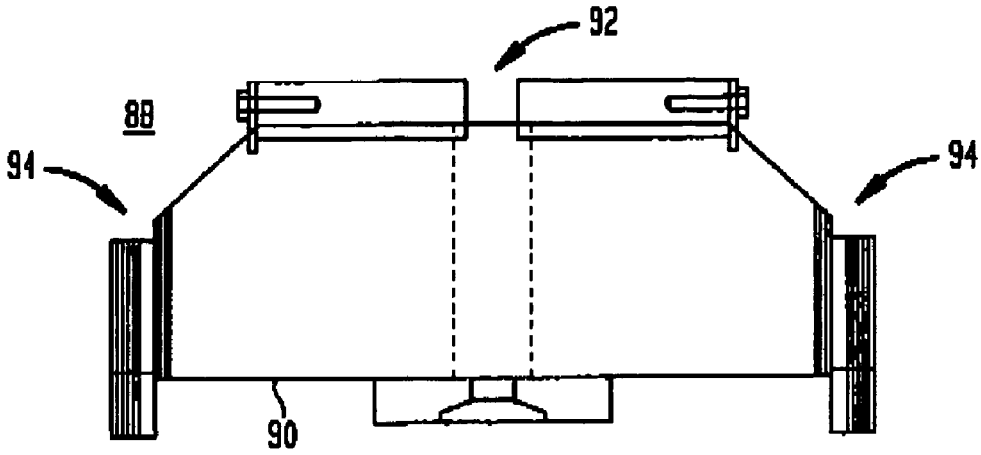
FIG. 8 illustrates a main plate of a yoke according to the present invention.
Figure 9:
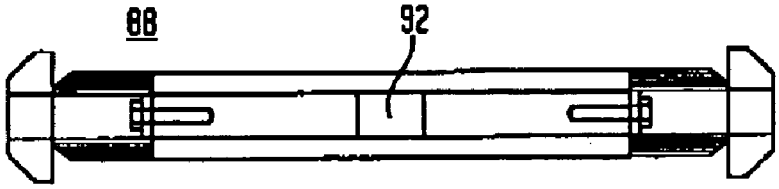
FIG. 9 is a plan view of the main plate according to the present invention.
Figure 10:
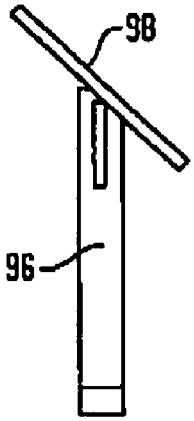
FIG. 10 is a plan view of a slidable plate of the yoke according to the present invention.

To clamp the foot member 25, a threaded bar 71 having a head on one end is inserted into an opening 100 from the top, as shown in FIG. 7*b*, and the through hole 92 of the main plate 90 disposed underneath the foot member 25. The left and right plates 96 are adjusted by sliding them into or out of the main plate 90 until the angled rods 98 are underneath the top flanges 86 of the two stub member 82. Then a nut is threaded and secures the foot member 25 to the stub members 82.

It is to be noted also that the clamps 88 are generally not necessary because the lower and upper baskets 16, 18 with their outriggers 24 provide sufficient lateral support to prevent any uplift of the lifting device 12 during operation of the crane 12. The clamps 88 are provided to secure the crane 142 only under unexpectedly extreme conditions and to sometimes satisfy certain safety regulations. In fact, the lower basket 18 provides most of the lateral support that not even the upper basket 16 may be needed for proper operation. This principle is similar to that of a free-standing crane on a truck where the truck has extended outriggers resting on the ground. Just as the extended outriggers provide lateral support for the free standing crane, the lower basket 18 with its extended outriggers 24 provide sufficient lateral support to prevent the crane 12 from tipping over.

As discussed above, the weight of the lifting device 14, tower 10 and crane 12 are principally distributed on the vertical columns 22. The turning moment or the lateral load of the crane 12 is also principally transferred through the sloped arms 34, 38, 54, 56 to the vertical columns 22. As can be appreciated by persons of ordinary skill in the art, these features provide several important advantages. Because the lateral and vertical loads are distributed on the vertical columns 22, there is no need to reinforce the horizontal beams or the floors to accommodate the crane 12. Because the entire tower 10 moves up as the floors are added, no tower sections need to be added. Nor is there a need for a reinforced foundation and tie rods to prevent the tower crane 12 from tipping prior to the time the crane 12 is first jumped. Further, no chucking is needed to brace the tower 10 against the horizontal slabs or beams since the lateral load is transferred as principally a vertical force to the columns. As can be appreciated, the lifting device 14 of the present invention provides substantial cost savings over the prior art tower cranes. For a typical 45 story steel building the savings in steel cost and labor alone are estimated to be in the half a million to one million dollar range.

Figure 14:
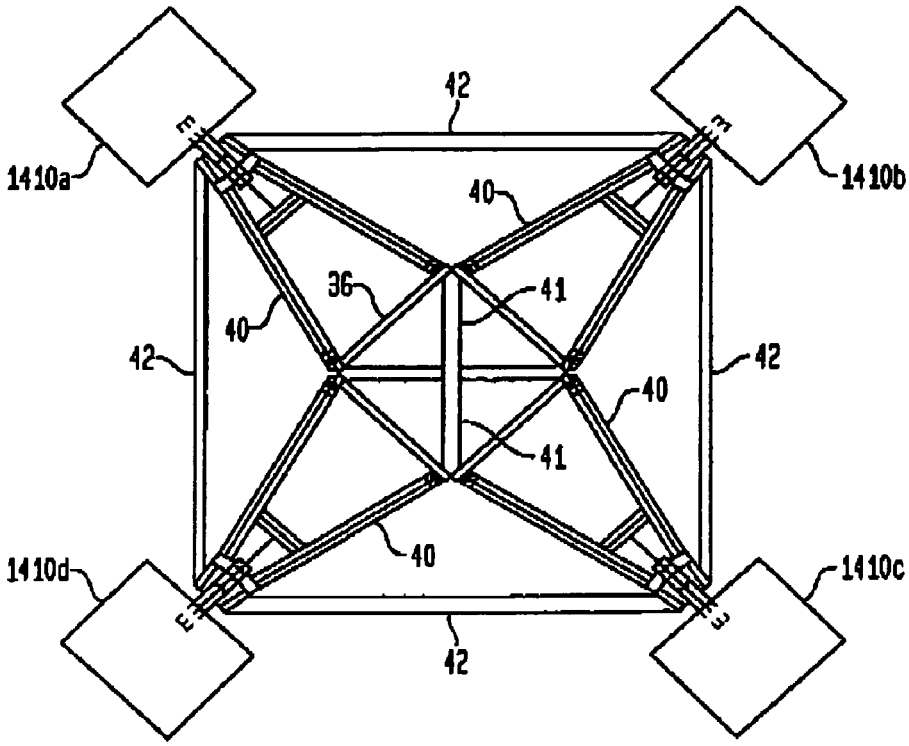
FIG. 14 illustrates a plurality of cement column openings.

The principles of the present invention can be employed in concrete buildings as wells as shown in FIG. 14. Instead of support stubs 28, openings 1405 on the cement columns 1410 or vertical bearing walls, preferably at each corner, are made as the floors are raised and the foot members 25 are inserted into the openings 1405 rather than extended over the stubs 28 so that the crane load and the lateral load is principally a columns 1410.

A climbing operation of the present invention will now be explained with reference to FIGS. 1, 4 and 13. The climbing operation is done in two steps. First, using the climbing frame 60, the upper basket 16 is raised around the tower 10 and seated upon the support stubs 28 at the desired level. Then using the upper basket 16 as the support, the lower basket 18, along with the tower 10, is raised to its desired level.

Figure 13A:
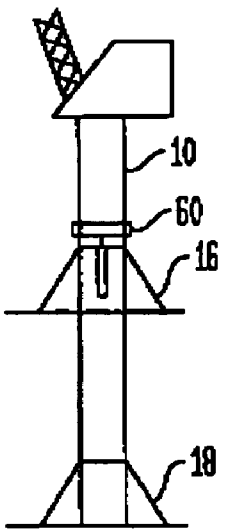
FIGS. 13A to 13E illustrate the climbing operation of the lifting device according to the present invention.
Figure 13B:
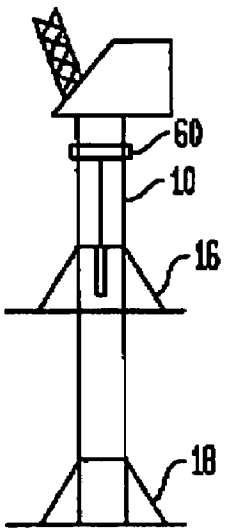
Figure 13C:
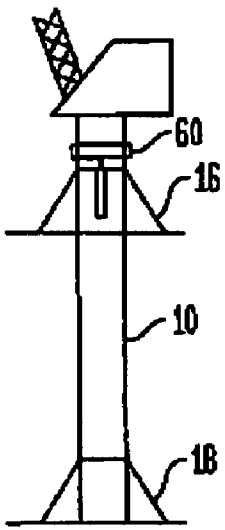

The climbing operation is shown in more detail in FIGS. 13A to 13E. FIG. 13A shows the lifting device 14 and tower 10 prior to the climbing operation. At this point, the climbing dogs 70 are in their unlocked position and the basket dogs 80 are in the locked position. Then, the cylinders 68 extend their pistons 69 to raise the lifting frame 60 around the tower 10 as shown in FIG. 13B. When the pistons 69 are appropriately extended, the climbing dogs 70 are rotated into the locked position and are disposed on top of the horizontal brace 62 while the basket dogs 80 are rotated into the unlocked position if they are locked. With the climbing dogs 70 in the locked position and the basket dogs 80 in the unlocked position, the outriggers 24 retract their foot members away from the stubs 28 to prepare the upper basket 16 for climbing. The cylinders 68 then retract the pistons 69 thus raising the upper basket 16 toward the climbing frame 60 as shown in FIG. 13C. In an alternative embodiment, the outriggers 24 can retract their foot members at the same time the upper basket 16 is raised. When the pistons 69 are appropriately retracted, the basket dogs 80 are rotated into the locked position and are disposed on top of the horizontal brace 62. The pistons 69 are then slightly extended until the basket dogs 80 take the load of the upper basket 16.

The climbing steps of raising the climbing frame 60 and then the upper basket 16 as described above and as shown in FIGS. 13B and 13C can be repeated as many times as necessary to raise the upper basket 16 to a desired level. For example, in one embodiment the cylinders 68 have a 15 feet stroke. Thus, to raise the tower crane by 40 feet, the climbing steps are repeated three times. The first two times, the basket is raised by 15 feet and the third time, the basket is raised by 10 feet.

Once the upper basket 16 is raised to its desired level, the outriggers 24 extend the foot members 25 over the stubs 28. The lower basket 18 is now raised to its desired level by the following steps.

Figure 13D:
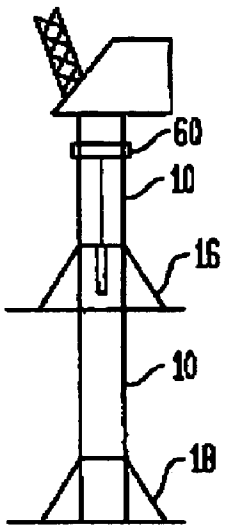
Figure 13E:
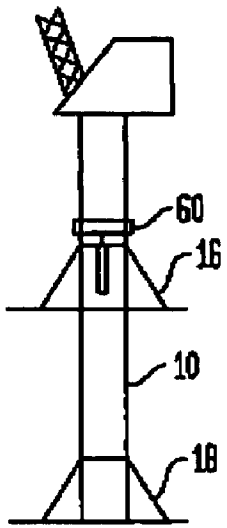

The climbing dogs 70 are pulled back to the unlocked position and the pistons 69 are retracted so that the dogs are positioned slightly below the angles 66. The climbing dogs 70 are then rotated into the locked position just below the angles 66. The cylinders 68 then extend the pistons 69. Because the climbing dogs 70 engage the underside of the angles 66, the extending movement of the pistons 69 raises the climbing frame 60, the tower 10 and the lower basket 18 as shown in FIG. 13D. While the lower basket 18 is being raised, the foot members 25 in the outriggers 24 on the lower basket are retracted. When the pistons 69 are appropriately extended, the basket dogs 80 are rotated into the locked position under the angles 66 to prevent the tower 10 from moving downward. The pistons 69 are slightly retracted to release the climbing dogs 70 and thereby the climbing frame 60 from the tower 10. The pistons 69 are then retracted to bring the climbing frame 60 toward the upper basket 16 as shown in FIG. 13E. The climbing steps for the lower basket 18 as described above are repeated the same number of times as those for raising the upper basket 16.

Once the lower basket 18 is raised to its desired level, the outriggers 24 of the lower basket extend their foot members 25 over the respective stubs 28. The climbing frame 60 is then slightly lowered by retraction of the pistons 69 until all load is transferred to the stubs 28. The clamp 88 is used to secure the lower basket 18 to the stubs 28 to prevent any uplift that may occur during an extraordinary and unanticipated load. Although the embodiment shown uses the clamp 88 for only the lower basket 18, the same type of clamps can be used for the upper basket 16 to provide additional stability.

As can be appreciated, unlike the conventional crane climbing devices which may take one day or more to jump the crane, the present lifting device 14 can efficiently jump the crane within a couple of hours, resulting in very little down time.

From the foregoing, it will be appreciated that, although specific embodiments of the invention have been described herein for purposes of illustration, various modifications may be made without deviating from the spirit and scope of the invention. For example, while the cylinders 68 are shown as attached to the upper basket 16, they can instead be attached to the lower basket 18. Further, while the foot members 25 are shown as Y-shaped beams, persons of ordinary skill in the art will readily recognize that the foot members can be of other shapes such as a simple rod for insertion into a hole on the vertical columns, for example. Still further, the climbing frame 60 can be disposed between the lower and upper baskets 16, 18, rather than above the upper basket. Accordingly, the present invention is not limited except as by the appended claims.

What is claimed is:

1. A method of lifting a tower crane extending through an opening in a structure of a building under construction, comprising:

resting a first basket supporting a tower on vertical columns of the structure;

resting a second basket on the vertical columns of the structure, the second basket being slidable with respect to the tower;

providing a climbing frame slideably coupled to the tower;

raising the climbing frame with respect to the tower while the second basket is in a stationary position and the first basket is supporting the tower; and raising the second basket with respect to the tower while the climbing frame is in a stationary position.

2. The method according to claims 1, further comprising repeating the steps of raising the climbing frame and raising the second basket until the second basket reaches a desired level.

3. The method according to claim 1, further comprising raising the first basket using the climbing frame while the second basket is in a stationary position.

4. The method as set forth in claim 3, wherein raising the first basket using the climbing frame while the second basket is in the stationary position includes positioning a locking device attached to the climbing frame below a member of the tower, and extending a compressed lifter attached to the climbing frame and the second basket.

5. The method as set forth in claim 4, wherein the member is a horizontal member of the tower.

6. The method as set forth in claim 4, wherein the lifter is at least one hydraulically operated jack including a cylinder attached to the second basket and a piston attached to the climbing frame.

7. The method as set forth in claim 4, wherein the locking device is a dog, the dog being rotatable about a pin for positioning and for locking the dog below the member.

8. The method as set forth in claim 1, wherein raising the climbing frame with respect to the tower while the second basket is in the stationary position and the first basket is supporting the tower includes extending a lifter attached to the climbing frame and the second basket.

9. The method as set forth in claim 8, wherein the lifter is at least one hydraulically operated jack including a cylinder attached to the second basket and a piston attached to the climbing frame.

10. The method as set forth in claim 1, wherein raising the second basket with respect to the tower while the climbing frame is in the stationary position includes positioning a locking device attached to the climbing frame above a member of the tower, and compressing an extended lifter attached to the climbing frame and the second basket.

11. The method as set forth in claim 10, wherein the member is a horizontal member of the tower.

12. The method as set forth in claim 10, wherein the lifter is at least one hydraulically operated jack including a cylinder attached to the second basket and a piston attached to the climbing frame.

13. The method as set forth in claim 10, wherein the locking device is a dog, the dog being rotatable about a pin for positioning and for locking the dog above the member.

14. A method of lifting a tower crane extending through an opening in a structure under construction, comprising:

resting a first basket supporting a tower on the structure;

resting a second basket on the structure, the second basket being slidable with respect to the tower;

providing a climbing frame slideably coupled to the tower;

raising the climbing frame with respect to the tower while the second basket is in a stationary position and the first basket is supporting the tower; and raising the second basket with respect to the tower while the climbing frame is in a stationary position.

15. The method according to claim 14, further comprising repeating the steps of raising the climbing frame and raising the second basket until the second basket reaches a desired level.

16. The method according to claim 14, further comprising raising the first basket using the climbing frame while the second basket is in a stationary position.

17. The method as set forth in claim 16, wherein raising the first basket using the climbing frame while the second basket is in the stationary position includes positioning a locking device attached to the climbing frame below a member of the tower, and extending a compressed lifter attached to the climbing frame and the second basket.

18. The method as set forth in claim 17, wherein the member is a horizontal member of the tower.

19. The method as set forth in claim 17, wherein the lifter is at least one hydraulically operated jack including a cylinder attached to the second basket and a piston attached to the climbing frame.

20. The method as set forth in claim 17 wherein
the locking device is a dog, the dog being rotatable about a pin for positioning and for locking the dog below the member.

21. The method as set forth in claim 14, wherein
raising the climbing frame with respect to the tower while the second basket is in the stationary position and the first basket is supporting the tower includes
extending a lifter attached to the climbing frame and the second basket.

22. The method as set forth in claim 14, wherein
the lifter is at least one hydraulically operated jack including a cylinder attached to the second basket and a piston attached to the climbing frame.

23. The method as set forth in claim 14, wherein
raising the second basket with respect to the tower while the climbing frame is in the stationary position includes
positioning a locking device attached to the climbing frame above a member of the tower, and
compressing an extended lifter attached to the climbing frame and the second basket.

24. The method as set forth in claim 23, wherein
the member is a horizontal member of the tower.

25. The method as set forth in claim 23, wherein
the lifter is at least one hydraulically operated jack including a cylinder attached to the second basket and a piston attached to the climbing frame.

26. The method as set forth in claim 23, wherein
the locking device is a dog, the dog being rotatable about a pin for positioning and for locking the dog above the member.

27. A method of lifting a tower crane extending through an opening in a structure under construction, comprising:
resting a first basket supporting a tower on the structure;
resting a second basket on the structure, the second basket being slidable with respect to the tower;
providing a climbing frame slideably coupled to the tower;
raising the climbing frame with respect to the tower while the second basket is in a stationary position and the first basket is supporting the tower by
extending a lifter attached to the climbing frame and the second basket;
raising the second basket with respect to the tower while the climbing frame is in a stationary position by
positioning a dog attached to the climbing frame above a member of the tower, and
compressing the extended lifter attached to the climbing frame and the second basket; and
raising the first basket using the climbing frame while the second basket is in a stationary position by
positioning the dog attached to the climbing frame below the member of the tower, and
extending the compressed lifter attached to the climbing frame and the second basket.

28. The method as set forth in claim 27, wherein
the lifter is at least one hydraulically operated jack including a cylinder attached to the second basket and a piston attached to the climbing frame.

29. A method of lifting a tower crane extending through an opening in a structure under construction, comprising:
resting a plurality of first slidable foot members of a first basket supporting a tower on the structure;
resting a plurality of second slidable foot members of a second basket on the structure, the second basket being slidable with respect to the tower;
providing a climbing frame slideably coupled to the tower;
raising the climbing frame with respect to the tower while the second basket is in a stationary position and the first basket is supporting the tower by
extending a lifter attached to the climbing frame and the second basket;
engaging a locking device attached to the climbing frame to the tower in a first position; retracting the plurality of second slidable foot members;
raising the second basket with respect to the tower while the climbing frame is in a stationary position by
compressing the extended lifter attached to the climbing frame and the second basket;
extracting the plurality of second slidable foot members;
retracting the plurality of first slidable foot members;
disengaging the locking device;
reengaging the locking device to the tower in a second position;
raising the first basket using the climbing frame while the second basket is in a stationary position by
extending the compressed lifter attached to the climbing frame and the second basket; and
extracting the plurality of first slidable foot members.

30. The method as set forth in claim 29, wherein
the locking device is a dog, and
engaging the locking device includes
positioning the dog above a member of the tower.

31. The method as set forth in claim 30, wherein
disengaging the locking device includes
removing at least one pin from the dog so that the dog is operable for rotating about a stationary pin.

32. The method as set forth in claim 31, wherein
reengaging the locking device includes
lowering the climbing frame,
positioning the dog below the member of the tower, and
inserting the at least one pin into the dog for locking the dog.

33. The method as set forth in claim 29, wherein
retracting the plurality of first slidable foot members, retracting the plurality of second slidable foot members, extracting the plurality of first slidable foot members and extracting the plurality of second slidable foot members is performed using at least one hydraulic system.

* * * * *